US005190487A

United States Patent [19]

Fukui

[11] Patent Number: 5,190,487

[45] Date of Patent: Mar. 2, 1993

[54] CONTROL APPARATUS FOR AN OUTBOARD MARINE ENGINE

[75] Inventor: Wataru Fukui, Himeji, Japan

[73] Assignee: Mitsubishi Denki Kabushiki Kaisha, Tokyo, Japan

[21] Appl. No.: 871,751

[22] Filed: Apr. 21, 1992

[30] Foreign Application Priority Data

Apr. 24, 1991 [JP] Japan ..... 3-092535

[51] Int. Cl.[5] ..... B63H 1/18

[52] U.S. Cl. ..... 440/1; 416/25

[58] Field of Search ..... 440/1, 2, 49; 416/25, 416/27, 30, 1; 123/349, 395

[56] References Cited

U.S. PATENT DOCUMENTS 3,314,391 4/1967 Duport ..... 440/1

4,861,291 8/1989 Koike ..... 440/1

FOREIGN PATENT DOCUMENTS 0145194 6/1988 Japan ..... 416/25

277863 6/1988 Japan .

*Primary Examiner*—Sherman Basinger

*Attorney, Agent, or Firm*—Sughrue, Mion, Zinn, Macpeak & Seas

[57] ABSTRACT

An outboard marine engine capable of preventing the generation of cavitation around a propulsion screw due to an abrupt increase in the rotational speed thereof for improved acceleration performance. To this end, a rotational speed sensor senses the number of revolutions per minute of the engine, and a bubble sensor senses the amount of bubbles generated around the propulsion screw and generates a corresponding bubble signal. A controller generates, based on the output signals of the sensors, a drive signal for controlling engine operating parameters. The controller includes a speed limiter for determining, based on the bubble signal from the bubble sensor, whether the amount of bubbles generated around the screw is equal to or greater than a predetermined value. An actuator is driven by the drive signal to control the engine operating parameters in a manner to limit the number of revolutions per minute of the engine when the speed limiter determines that the amount of bubbles is equal to or greater than the predetermined value.

7 Claims, 3 Drawing Sheets

CONTROL APPARATUS FOR AN OUTBOARD MARINE ENGINE

BACKGROUND OF THE INVENTION

The present invention relates to a control apparatus for controlling the operation of an outboard marine engine. More particularly, it relates to such an engine control apparatus which is effective to prevent a reduction in propulsion force due to cavitation (under unloaded or idling operation) caused by bubbles produced by a propulsion screw, thereby providing for improved acceleration performance.

FIG. 3 schematically illustrates a typical example of an outboard marine engine mounted on a boat at a location outside a boat hull. In this figure, the engine 1 in the form of an internal combustion engine for outboard use is disposed outside a boat hull 3 at the stern thereof and mounted to the boat hull 3 through a mounting member 1*a*. A propulsion screw 2 is disposed under water and operatively connected with the engine 1 so that it is thereby driven to rotate.

FIG. 4 shows in block form the general construction of a conventional engine control apparatus for controlling the outboard engine 1 of FIG. 3. In this figure, a rotational speed sensor 4 is mounted on a camshaft or crankshaft (not illustrated) of the engine 1 so that it generates a crank signal representative of a reference crankshaft position in synchronization with the rotation of the unillustrated crankshaft for sensing the rotational speed or the number of revolutions per minutes of the engine 1 and generating a corresponding output signal R. A throttle sensor 5 senses the throttle opening or the degree of opening of a throttle valve (not shown) of the engine 1 corresponding to the quantity of depression of an unillustrated accelerator pedal of the engine 1 by an operator, and generates a corresponding throttle signal $\alpha$. A controller 6 receives output signals from various sensors indicative of various engine operating conditions including the output signals R, $\alpha$ of the rotational speed sensor 4 and the throttle sensor 5, and generates a drive signal A for controlling various engine control parameters on the basis of these output signals. An actuator means 7 is operatively connected to the controller 6 so that it is driven to operate by means of the drive signal A from the controller 6. The actuator means 7 controls various driving and control elements or devices such as a fuel pump, an ignition coil, a throttle actuator or motor, a starter motor and the like associated with the engine 1.

Next, the operation of the above-described conventional engine control apparatus will be described in detail while referring to FIGS. 3 and 4. First, the controller 6 generates a drive signal A based on the output signals from the various sensors including the rotational speed signal R, the throttle signal $\alpha$, the reference crank signal and the like representative of various engine operating conditions, for controlling the actuator means 7 (e.g., for controlling a fuel pump, an ignition coil, a throttle valve, etc.) as well as calculating and controlling operational timings thereof such as fuel supply or injection timing, ignition timing, etc. In addition, the controller 6 also determines, in response to the gear position of an unillustrated transmission, a proper degree of throttle opening $\alpha$ so that the flow rate of intake air sucked into the engine 1 is thereby properly adjusted to provide a desired number of revolutions per minute of the engine 1.

Here, it should be noted that in the case of the marine engine 1 for outboard use, the propulsion screw 2 entrains or draws in air at the time of engine starting or acceleration, so there develop a great deal of bubbles around the screw 2. In particular, such a tendency becomes remarkable when the engine in operation is moved or pivoted about the mounting member 1*a* in a direction (i.e., in the counterclockwise direction in FIG. 3) designated by an arrow.

If a great amount of bubbles are produced by the screw 2, the thrust or propulsion force thereof would be accordingly reduced under the influence of resultant cavitation (i.e., unloaded operation), thus resulting in that a desired acceleration could not be obtained. In order to avoid this situation, the controller 6 generates an appropriate drive signal A so as to suppress an abrupt increase in the rotational speed of the engine 1 at all times irrespective of the presence or absence of bubbles around the screw 2. This inevitably reduces the maximum acceleration performance of the engine 1.

SUMMARY OF THE INVENTION

Accordingly, the present invention is aimed at overcoming the above-described problems of the conventional engine control apparatus.

Thus, it is an object of the invention to provide a novel and improved control apparatus for an outboard marine engine which is able to control the engine in such a manner as to prevent an abrupt increase in the rotational speed only when an amount of bubbles in excess of a predetermined value is generated around a propulsion screw, thereby avoiding resultant generation of cavitation while ensuring a maximum degree of accelerability.

In order to achieve the above object, according to the present invention, there is provided a control apparatus for an outboard marine engine having a propulsion screw, the apparatus comprising: a rotational speed sensor for sensing the number of revolutions per minute of the engine and generating a rotational speed signal; a bubble sensor for sensing the amount of bubbles generated around the propulsion screw and generating a corresponding bubble signal; a controller operatively connected to receive the output signals of the sensors for generating, based on these signals, a drive signal which controls engine operating parameters, the controller including a speed limiting means for determining, based on the bubble signal from the bubble sensor, whether the amount of bubbles generated around the screw is equal to or greater than a predetermined value; actuator means operatively connected to receive the drive signal from the controller so that it is thereby driven to control the engine operating parameters in a manner to limit the number of revolutions per minute of the engine when the speed limiting means determines that the amount of bubbles is equal to or greater than the predetermined value.

The above and other objects, features and advantages of the invention will become apparent from the ensuing detailed description of the invention taken in conjunction with the accompanying drawings.

DESCRIPTION OF THE PREFERRED EMBODIMENT

A preferred embodiment of the invention will now be described in detail with reference to the accompanying drawings.

Figure 1:
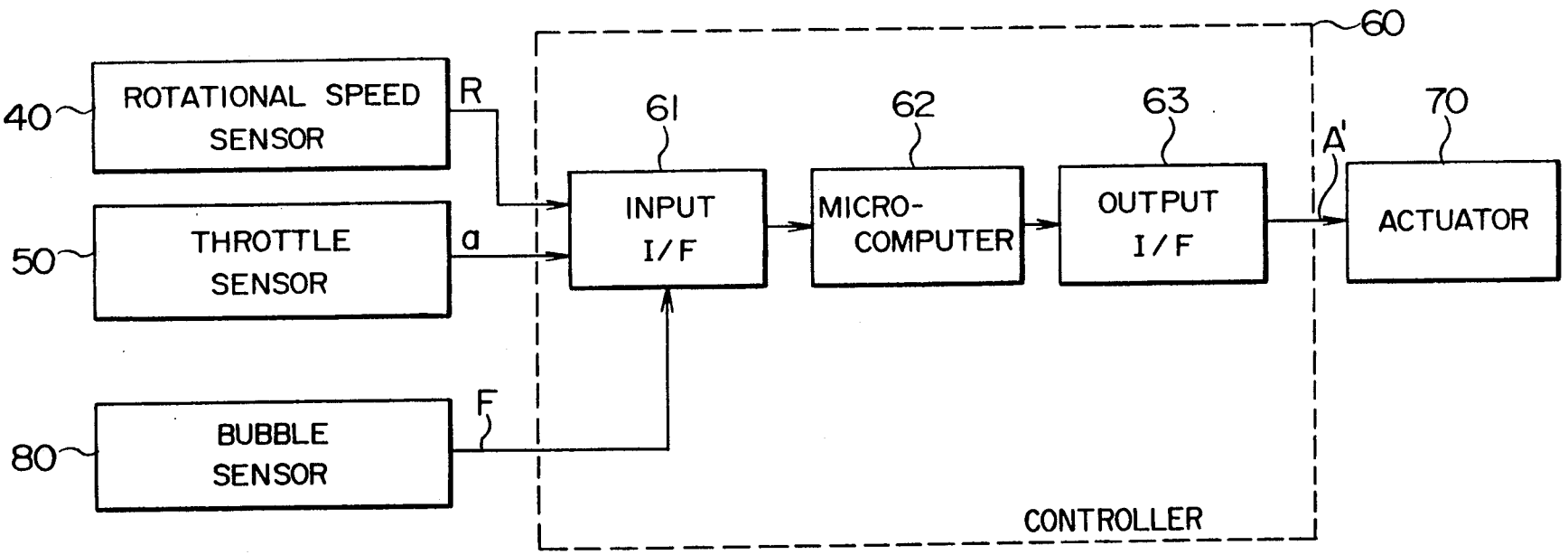
FIG. 1 is a block diagram of an engine control apparatus for an outboard marine engine in accordance with the present invention.

FIG. 1 shows in block form an engine control apparatus for controlling the operation of an outboard marine engine constructed in accordance with the principles of the present invention. In this figure, the apparatus illustrated includes, in addition to a rotational speed sensor 40, a throttle sensor 50 and an actuator means 70 all of which are similar to the corresponding elements 4, 5 and 7, respectively, of FIG. 3, a bubble sensor 80 for sensing the generation of bubbles around the propulsion screw 2 of the marine engine 1 (see FIG. 3) and generating a corresponding bubble signal F, and a controller 60 for controlling the actuator means 70 on the basis of the output signals from the sensors 40, 50 and 80 as well as other signals from unillustrated sensors representative of various engine operating conditions.

The controller 60 comprises an input interface 61 to which various signals inclusive of a rotational speed signal R from the rotational speed sensor 40, a throttle signal $\alpha$ from the throttle sensor 50 and a bubble signal F from the bubble sensor 80 as well as other signals representative of various engine operating conditions are input, a microcomputer 62 for effecting computations and making determinations on the basis of various input signals supplied to the input interface 61 and generating a drive signal A' for controlling and driving the actuator means 70, and an output interface 63 for outputting the drive signal A' generated by the microcomputer 62 to the actuator means 70.

The bubble sensor 80 senses the amount of bubbles generated around the propulsion screw 2 and generates a corresponding bubble signal F to the input interface 61 of the controller 60. For example, the bubble sensor 80 comprises a resistance or capacitance sensor which senses a change in electrical resistance or capacitance between electrodes, or it may be a supersonic sensor which senses characteristic or intrinsic supersonic waves generated upon rupture or burst of bubbles. To this end, the bubble sensor 80 is disposed around the screw 2 or in the vicinity of the water level.

The microcomputer 62 in the controller 60 includes a speed limiting means for limiting the rotational speed or the number of revolutions per minute of the engine 1 in response to the bubble signal F from the bubble sensor 80. To this end, the speed limiting means determines, based on the bubble signal F from the bubble sensor, whether the amount of bubbles generated around the screw 2 is equal to or greater than a predetermined value.

Figure 2:
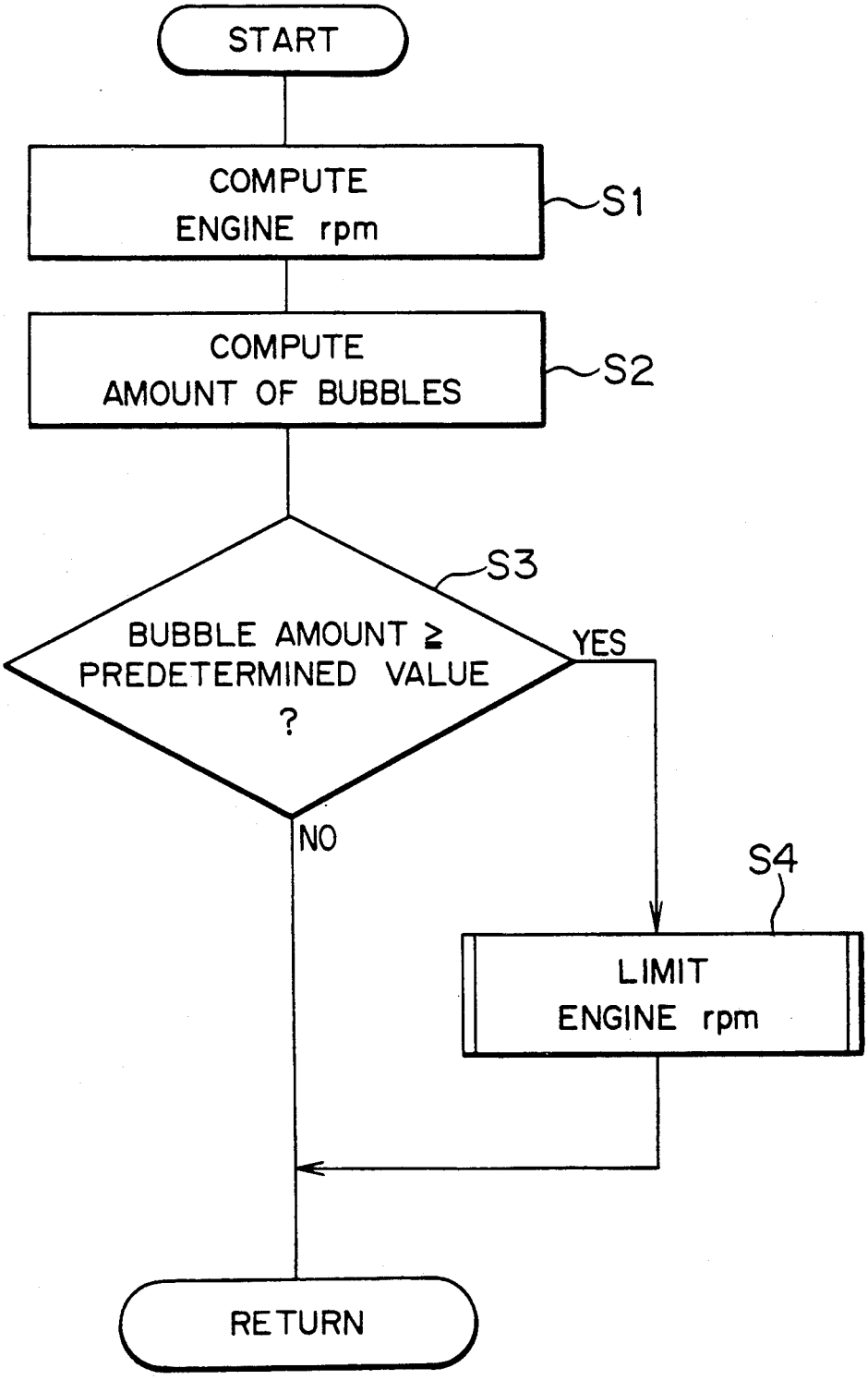
FIG. 2 is a flow chart showing the operational process of the apparatus of FIG. 1.
Figure 3:
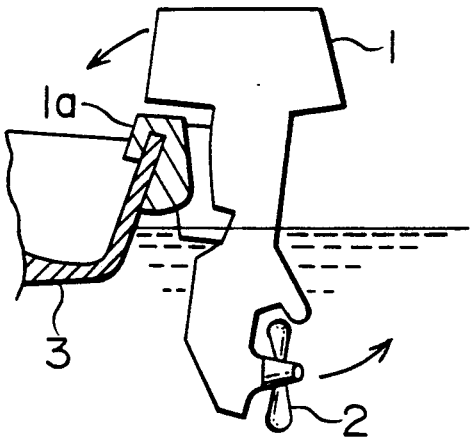
FIG. 3 is a schematic illustration showing the general construction of an outboard marine engine.
Figure 4:
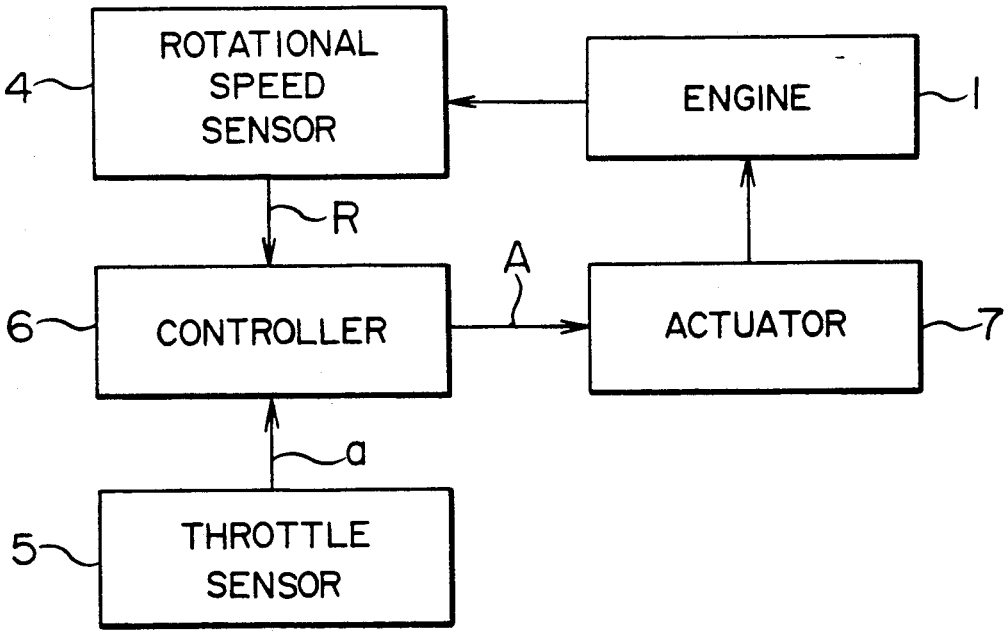
FIG. 4 is a block diagram of a conventional engine control apparatus for an outboard marine engine.

Next, the operation of the above embodiment will be described in detail while referring to the flow chart of FIG. 2 as well as FIG. 3. As shown in FIG. 2, first in Step S1, the microcomputer 62 computes the rotational speed or the number of revolutions per minute of the engine 1 based on the output signal R from the rotational speed sensor 40, and then in Step S2, it computes the amount of bubbles generated around the screw 2 based on the bubble signal F from the bubble sensor 80.

Subsequently in Step S3, it is determined whether the amount of bubbles thus obtained is equal to or greater than a predetermined value, that is whether there are a minimum amount of bubbles which create cavitation around the screw 2. If the answer to this question is "NO", a return is performed. If, however, the answer is "YES", then the microcomputer 62 generates a drive signal A' for decreasing the output power of the engine 1 in accordance with the rotational speed or number of revolutions per minute of the engine 1, thereby properly limiting the engine rotational speed to a predetermined level. Thus, a reduction in the output power or propulsion force of the screw 2 due to cavitation can be effectively avoided. In this regard, the predetermined limit level of the engine rotational speed can be determined through computations or look-up of a tabulated map on the basis of the rotational speed or the number of revolutions per minute of the engine 1 which has been obtained just or immediately before the receipt at the input interface 61 of the bubble signal F. Moreover, the control of decreasing the engine output power can be made by means of the drive signal A' supplied to the actuator means 70 in a variety of ways. For example, on the basis of the drive signal A', the actuator 70 reduces the amount of fuel supplied from an unillustrated fuel pump to the engine 1, or it properly delays the ignition timing of the engine 1 (i.e., conduction timing or power supply timing to an unillustrated ignition) from a normal ignition timing, or it decreases the throttle opening $\alpha$ (i.e., the degree of opening of an unillustrated throttle valve).

In this manner, even if a great deal of bubbles in excess of the predetermined value are being produced around the screw 2, this situation is sensed by the bubble sensor 80, so that the rotational speed or the number of revolutions per minute of the engine 1 can be properly limited below the predetermined level prior to the actual generation of cavitation, thus preventing resultant reduction in the propulsion force of the screw 2. This allows the engine 1 to exhibit its maximum acceleration performance in the absence of a significant amount of bubbles around the screw 2.

Although in the above embodiment, the amount of bubbles computed from the output signal F of the bubble sensor 80 is compared with the predetermined value for cavitation preventive control, the bubble signal F from the bubble sensor 80 can be directly compared with a predetermined vale for the same purpose. In addition, though the amount of bubbles is compared with the single predetermined value, it may be compared with a plurality of predetermined values so that the rotational speed or the number of revolutions per minute of the engine 1 can be controlled in a stepwise manner in dependence on the varying level of the generated bubbles.

What is claimed is:

1. A control apparatus for an outboard marine engine having a propulsion screw, said apparatus comprising:

a rotational speed sensor for sensing the number of revolutions per minute of the engine and generating a rotational speed signal;

a bubble sensor for sensing the amount of bubbles generated around the propulsion screw and generating a corresponding bubble signal;

a controller operatively connected to receive the output signals of said sensors for generating, based on these signals, a drive signal which controls engine operating parameters, said controller including a speed limiting means for determining, based on the bubble signal from said bubble sensor, whether the amount of bubbles generated around the screw is equal to or greater than a predetermined value;

actuator means operatively connected to receive the drive signal from said controller so that it is thereby driven to control the engine operating parameters in a manner to limit the number of revolutions per minute of the engine when said speed limiting means determines that the amount of bubbles is equal to or greater than the predetermined value.

2. A control apparatus according to claim 1, wherein said controller computes the amount of bubbles based on the bubble signal from said bubble sensor, and said speed limiting means compares the amount of bubbles thus computed with a predetermined value to make the above determination.

3. A control apparatus according to claim 1, wherein said determiner compares the bubble signal from said bubble sensor with a predetermined value to make the above determination.

4. A control apparatus according to claim 1, wherein said determiner compares the bubble signal with a plurality of predetermined values so that the number of revolutions per minute of the engine can be controlled in a stepwise manner in dependence on the varying level of the bubble amount.

5. A control apparatus according to claim 1, wherein said actuator reduces the fuel supply to the engine on the basis of the drive signal from said controller.

6. A control apparatus according to claim 1, wherein said actuator delays the ignition timing of the engine from a normal ignition timing on the basis of the drive signal from said controller.

7. A control apparatus according to claim 1, wherein said actuator decreases the throttle opening on the basis of the drive signal from said controller.

* * * * *